US005767811A

United States Patent [19]

Mandai et al.

[11] Patent Number: 5,767,811

[45] Date of Patent: Jun. 16, 1998

[54] CHIP ANTENNA

[75] Inventors: Harufumi Mandai, Takatsuki; Teruhisa Tsuru, Kameoka, both of Japan

[73] Assignee: Murata Manufacturing Co. Ltd.

[21] Appl. No.: 714,208

[22] Filed: Sep. 16, 1996

[30] Foreign Application Priority Data

Sep. 19, 1995 [JP] Japan ..... 7-239958

[51] Int. Cl.[6] ..... H01Q 1/24

[52] U.S. Cl. ..... 343/702; 343/895

[58] Field of Search ..... 343/895, 702, 343/787, 788, 718; H01Q 1/24

[56] References Cited

U.S. PATENT DOCUMENTS

| | | | |
|---|---|---|---|
| 2,472,106 | 6/1949 | Hansen | 343/727 |
| 5,136,303 | 8/1992 | Cho et al. | 343/718 |
| 5,245,745 | 9/1993 | Jensen et al. | 29/600 |
| 5,250,923 | 10/1993 | Ushiro et al. | 336/83 |
| 5,341,148 | 8/1994 | Walter et al. | 343/895 |
| 5,412,392 | 5/1995 | Tsunekawa | 343/702 |
| 5,541,610 | 7/1996 | Imanishi et al. | 343/895 |

FOREIGN PATENT DOCUMENTS

| | | |
|---|---|---|
| 687030 | 10/1994 | European Pat. Off. . |
| 649184 | 4/1995 | European Pat. Off. . |
| 2685130 | 6/1993 | France . |

*Primary Examiner*—Hoanganh T. Le

*Attorney, Agent, or Firm*—Ostrolenk, Faber, Gerb & Soffen, LLP

[57] ABSTRACT

A chip antenna comprising a substrate comprising either of a dielectric material or a magnetic material, at least one conductor formed on at least one side of the surface and the inside of the substrate, and at least two feeding terminals provided on the surface of the substrate for applying a voltage to the conductor, at least two feeding terminals being provided to at least one conductor among the above conductors.

14 Claims, 3 Drawing Sheets

CHIP ANTENNA

BACKGROUND OF THE INVENTION

1. Field of the Invention

The present invention relates to a chip antenna and composite parts thereof used for mobile communication and local area networks (LAN).

2. Description of the Related Art

FIG. 4 shows a prior art chip antenna 50 comprising an insulator 51, a coil conductor 52, a magnetic member 53, and external connecting terminals 54*a* and 54*b*.

A method for producing the prior art chip antenna 50 will now be explained in reference to FIGS. 5(*a*) through 5(*f*). As shown in FIG. 5(*a*), an insulation layer 55 is formed, a first L-shaped conductive pattern 56 is printed on the insulation layer 55 so that a drawing terminal S is formed on one side of the main face, and then a first magnetic pattern 57 having a high permeability is printed in the center of the insulation layer 55, wherein the other side of the insulation layer 55 will be the mounting face to the insulator 51. As shown FIG. 5(*b*), a first U-shaped nonmagnetic insulation layer 58 is printed so as to cover the right half section of the conductive pattern 56 and insulator layer 55 other than the first magnetic pattern 57. Then, as shown in FIG. 5(*c*), a second L-shaped conductive pattern 59 is printed so that one end of the conductive pattern 59 overlaps with the end section of the conductive pattern 56, and a second magnetic pattern 60 is printed on the first magnetic pattern 57.

Then, as shown in FIG. 5(*d*), a second U-shaped nonmagnetic insulating layer 61 is printed on the left half section of the second conductive pattern 59 and the insulation layer 55 other than the second magnetic pattern 60. These steps shown in FIGS. 5(*b*) through 5(*d*) were repeated a predetermined number of turns, but without forming a drawing terminal. Then, as shown in FIG. 5(*e*), a final U-shaped conductive pattern 62 is printed so that one end of the conductive pattern 62 overlaps with the end of the former conductive pattern 59, and the other end of the conductive pattern 62 is exposed at the edge of the nonmagnetic insulating layer 61 to form a drawing terminal F. In such a manner, the coil conductor 52 having drawing terminals S and F is formed of the conductive patterns 56, 59 and 62.

As shown in FIG. 5(*f*), an insulating layer 63 is finally printed on the entire face to complete the laminating process. In such a manner, the insulator 51 is formed of the insulation layers 55, 58, 61 and 63, and the magnetic member is formed of the magnetic patterns 57 and 60. The laminate is burnt at a given temperature for a given time to form a monolithic sintered member, and then external connecting terminals 54*a* and 54*b* are adhered to the drawing terminals S and F followed by baking to obtain the chip antenna 50. The external connecting terminal 54*a* connecting with the drawing terminal S is served as a feeding terminal.

Such a prior art chip antenna responds to only one resonance frequency due to one feeding terminal.

SUMMARY OF THE INVENTION

It is an object of the present invention to provide a chip antenna which can respond to at least two resonance frequencies.

In accordance with the present invention, a chip antenna comprises a substrate comprising one of a dielectric material and a magnetic material, at least one conductor formed on at least one of a side of a surface of the substrate and inside the substrate, and at least two feeding terminals provided on the surface of the substrate for applying a voltage to the at least one conductor, at least two said feeding terminals being provided to said at least one conductor.

Because a plurality of feeding terminals are provided to a conductor in the chip antenna in accordance with the present invention, the single chip antenna can respond to a plurality of resonance frequencies.

Other features and advantages of the present invention will become apparent from the following description of the invention which refers to the accompanying drawings.

DETAILED DESCRIPTION OF EMBODIMENTS OF THE INVENTION

Figure 1:
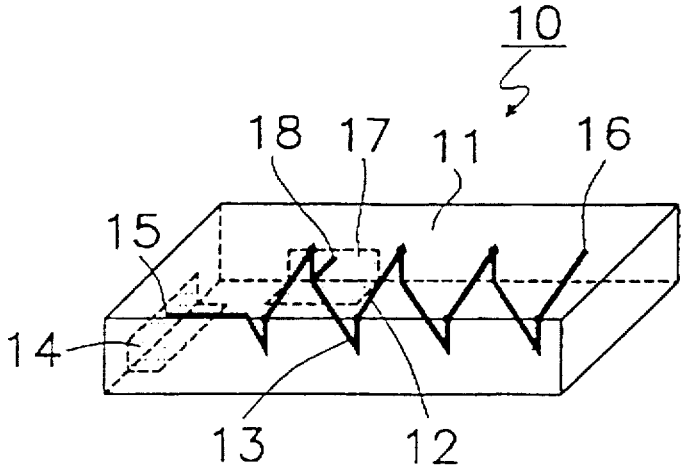
FIG. 1 is an isometric view illustrating an embodiment of a chip antenna in accordance with the present invention.
Figure 2:
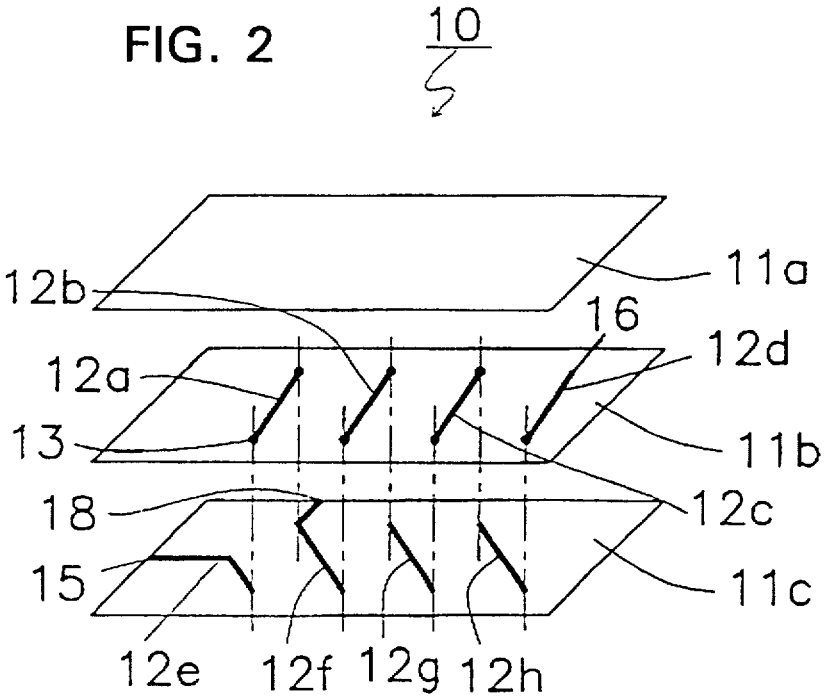
FIG. 2 is a decomposed isometric view of the chip antenna in FIG. 1.

Embodiments in accordance with the present invention will now be explained with reference to the drawings. FIG. 1 is an isometric view illustrating an embodiment of a chip antenna in accordance with the present invention, and FIG. 2 is a decomposed isometric view of FIG. 1.

The chip antenna 10 comprises a conductor 12 spiralled in a rectangular parallelopiped substrate 11 in the longitudinal direction of the substrate 11. The substrate 11 is formed by laminating rectangular dielectric sheets 11*a* through 11*c* each comprising a dielectric material mainly containing barium oxide, aluminum oxide and silica. The dielectric sheets 11*b* and 11*c* are provided on their surfaces with linear conductive patterns 12*a* through 12*h*, respectively, which are formed by, e.g., printing, evaporation, adhesion, or plating, and comprise copper or a copper alloy. The sheet 11*b* is further provided with via holes 13. The sheets 11*a* through 11*c* are laminated so that the conductive patterns 12*a* through 12*h* connect with each other through the via holes 13 to form the spiral conductor 12 having a rectangular cross-section.

Figure 3:
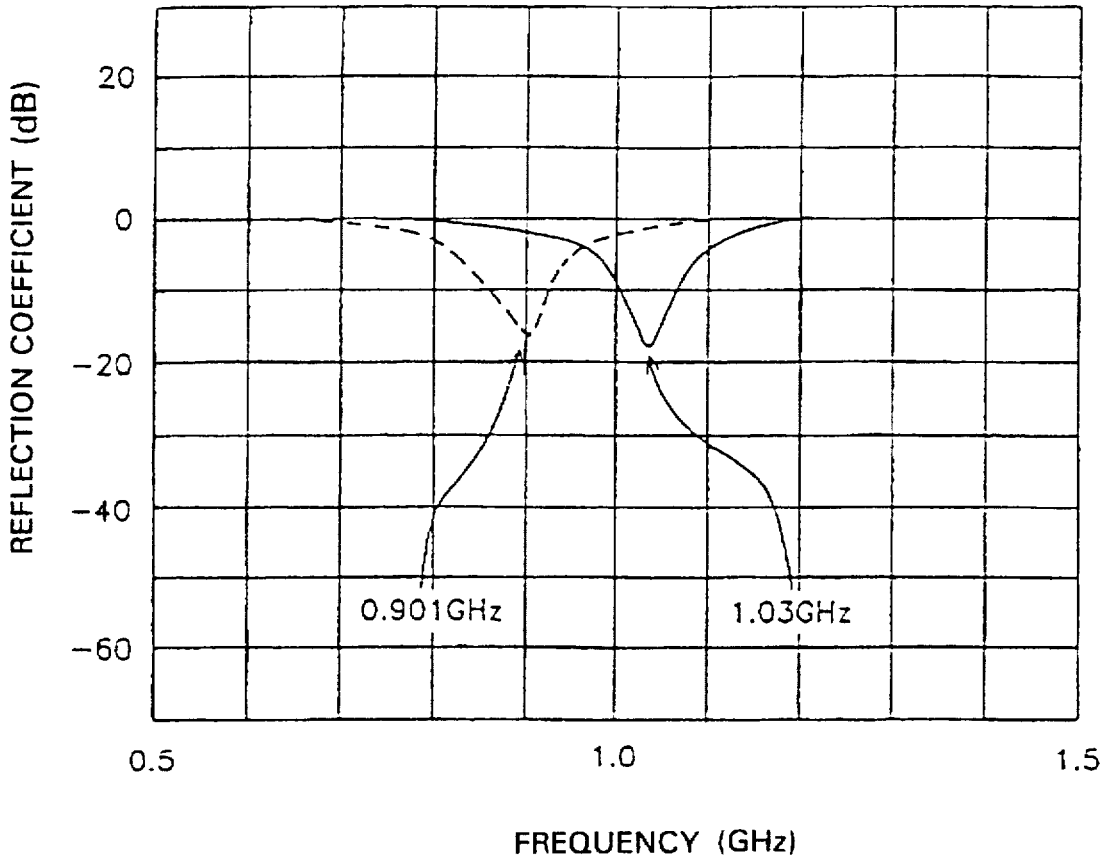
FIG. 3 is a graph illustrating reflection loss characteristics of the chip antenna in FIG. 1.
Figure 4:
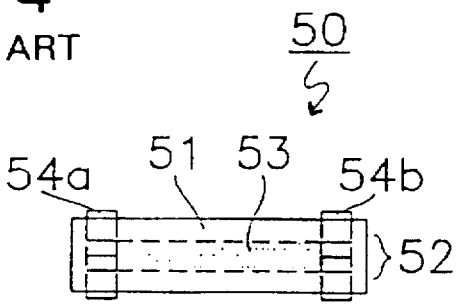
FIG. 4 PRIOR ART
FIG. 4 is a cross-sectional view illustrating a prior art chip antenna.
Figure 5:
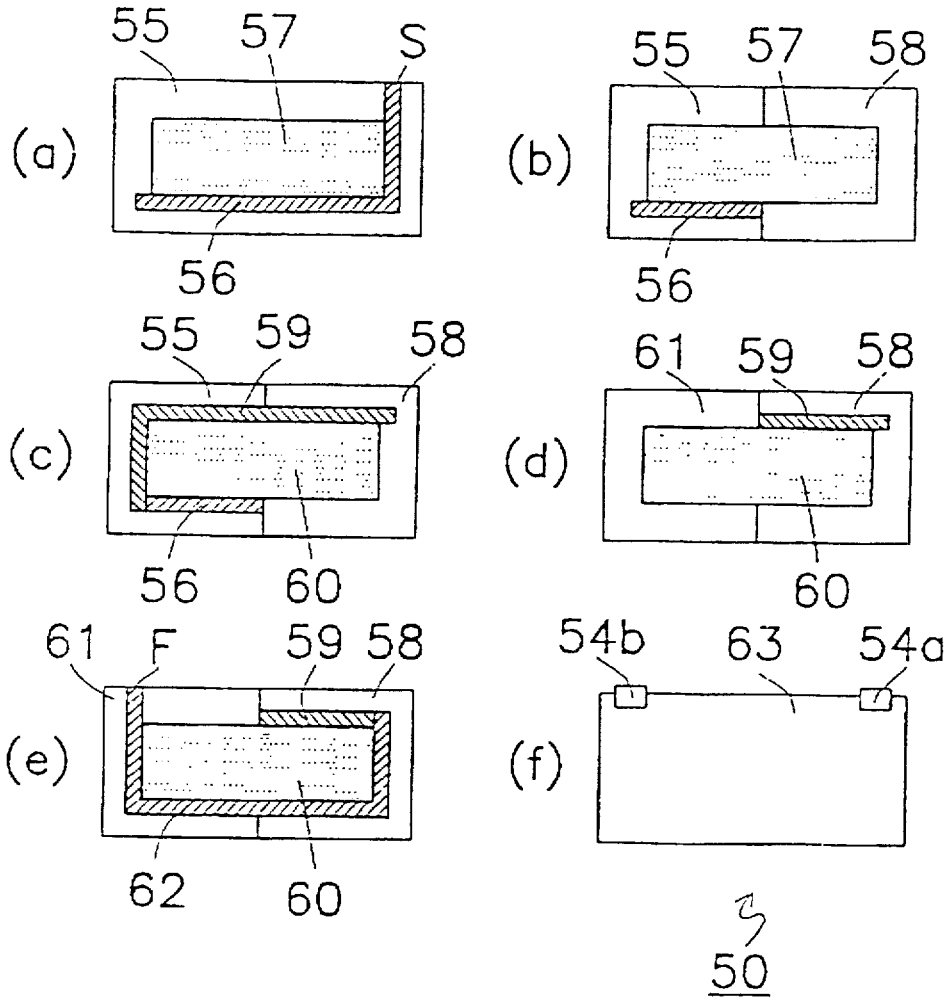
FIG. 5 is an outlined plan view illustrating a method for producing the prior art chip antenna of FIG. 4.

One end of the conductor 12, the end of the conductive pattern 12*e*, is drawn out to the surface of the substrate 11 to form a feeding section 15 which connects with a first feeding terminal 14 on the surface of the substrate 11 for applying a voltage to the conductor 12. The other end of the conductor 12, the end of the conductive pattern 12*d*, forms a free end 16 inside the substrate 11. Further, a second feeding section 18 connecting a second feeding terminal 17 provided on the surface of the substrate 11 is provided at a given position of the conductor 12 at an end of the conductive pattern 12*f* for applying a voltage to the conductor 12. As shown in FIG. 3, the length from the first feeding section 15 to the free end 16 and the length from the second feeding section 18 to the free end 16 are determined so that their respective resonance frequencies are 0.901 GHz (the broken line in FIG. 3) and 1.03 GHz (the solid line in FIG. 3).

In the chip antenna set forth in the above embodiment, since one conductor is provided with two feeding terminals, the chip antenna can respond to two resonance frequencies by switching the two feeding terminals. Thus, an antenna device for sending/receiving two resonance frequencies can be fabricated into one chip antenna, resulting in the miniaturization of the antenna device.

Further, since each feeding section is provided for one resonance frequency, the band width of each resonance frequency is narrowed and thus interference between different resonance frequencies can be prevented.

In the embodiment set forth above, the substrate of the chip antenna, or the antenna section and high frequency switch section comprises barium oxide, aluminum oxide, and silica. However, materials for the substrate are not limited to such dielectric materials, but may include dielectric materials mainly containing titanium oxide and neodymium oxide; magnetic materials mainly containing nickel, cobalt, and iron; and combinations of such dielectric materials with such magnetic materials.

Although the spiral conductor is provided inside the substrate in the embodiments set forth above, the spiral conductor can be provided on at least one side of the surface and inside of the substrate. Alternately, a meander conductor may be formed on at least one side of the surface and inside of the substrate.

When a plurality of conductors are provided, a plurality of feeding terminals can be provided with at least one conductor.

The position of each feeding terminal of the chip antenna may vary from that shown in the drawings and is not essential for the practice of the present invention.

The chip antenna having a plurality of feeding sections in accordance with the present invention has characteristics identical to a chip antenna having a plurality of conductors.

The chip antenna in accordance with the present invention can be mounted with a switch as a switching means, and a duplexer on the same mounting board to connect with each other by means of microstrip lines or the like.

The chip antenna in accordance with the present invention, in which one conductor is provided with a plurality of feeding terminals, can respond to a plurality of resonance frequencies by switching a plurality of feeding terminals. Thus, a mobile communication device for sending/receiving a plurality of resonance frequencies may comprise one chip antenna, resulting in the miniaturization of the antenna device and the communication device.

Further, since each feeding section is provided for one resonance frequency, the bandwidth of each resonance frequency is narrowed and thus interference between different resonance frequencies can be prevented.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising:

a substrate comprising one of a dielectric material and a magnetic material;

at least one conductor formed on at least one of a surface of the substrate and inside said substrate; and at least two feeding terminals provided on the surface of said substrate for applying a voltage to said at least one conductor, said at least two said feeding terminals being electrically connected to said at least one conductor, said conductor having two ends, one of said ends being connected to one of said feeding terminals and the other end of said conductor being a free end, the other feeding terminal being connected to said conductor intermediate to said two ends of said conductor.

2. A chip antenna according to claim 1, wherein the substrate comprises a plurality of sheets of material, each sheet having a conductive pattern thereon, at least one of said sheets having a conductive via hole therein, said sheets being laminated together, the conductive patterns on said sheets being coupled together through said at least one via hole to form said at least one conductor.

3. A chip antenna according to claim 1, wherein the at least one conductor having said at least two feeding terminals has at least two resonance frequencies determined by the relative lengths of each said feeding terminal along the conductor to said free end.

4. A chip antenna according to claim 1, wherein the conductor has a spiral shape and is disposed inside the substrate.

5. A chip antenna according to claim 4, wherein the conductor is rectangular in cross-section.

6. A chip antenna according to claim 1, wherein the conductor has a spiral shape and is disposed on the surface of the substrate.

7. A chip antenna according to claim 6, wherein the conductor is rectangular in cross-section.

8. A chip antenna according to claim 1, wherein the conductor has a plurality of feeding terminals and a plurality of resonance frequencies.

9. A chip antenna according to claim 1, wherein the substrate comprises one of barium oxide, aluminum oxide, silica, titanium oxide and neodymin oxide.

10. A chip antenna according to claim 1, wherein the substrate comprises one of nickel, cobalt and iron.

11. A chip antenna according to claim 1, wherein the substrate comprises a combination of a dielectric and magnetic material.

12. A chip antenna according to claim 1, wherein the conductor comprises a meander conductor formed on at least one of an exterior surface of the substrate and an interior surface of the substrate.

13. A chip antenna according to claim 1, wherein the conductor comprises one of copper and copper alloy.

14. A chip antenna according to claim 1, wherein the conductor is formed by one of printing, evaporation, adhesion and plating.

* * * * *